United States Patent [19]

Skoog

[11] Patent Number: 4,679,512

[45] Date of Patent: Jul. 14, 1987

[54] METHOD OF AND APPARATUS FOR BURNING LIQUID AND/OR SOLID FUELS IN PULVERIZED FROM

[75] Inventor: Kurt Skoog, Väddö , Sweden

[73] Assignee: Stubinen Utveckling AB, Väddö , Sweden

[21] Appl. No.: 855,134

[22] Filed: Apr. 23, 1986

[30] Foreign Application Priority Data

May 20, 1985 [DE] Fed. Rep. of Germany ..... 3518080

[51] Int. Cl.[4] ..... F23D 1/00

[52] U.S. Cl. ..... 110/347; 110/262; 110/264; 239/549; 239/558; 431/284

[58] Field of Search ..... 110/262, 264, 347; 431/283, 284, 285, 8, 9; 239/404, 420, 549, 554, 558, 559

[56] References Cited

U.S. PATENT DOCUMENTS

| | | | |
|---|---|---|---|
| 4,208,180 | 6/1980 | Nakayasu et al. | 431/284 |
| 4,422,389 | 12/1983 | Schroder | 110/264 |
| 4,523,529 | 6/1985 | Poll | 110/264 X |
| 4,523,530 | 6/1985 | Kaminaka et al. | 110/264 |

*Primary Examiner*—Edward G. Favors
*Attorney, Agent, or Firm*—Pahl, Lorusso & Loud

[57] ABSTRACT

A method of and apparatus for burning liquid fuels such as oil or the like and/or solid fuels, especially coal, peat or the like, in pulverized form, the latter either in dry condition or mixed with a carrier liquid such as water and/or oil to form an emulsion being introduced together with the liquid fuel into a combustion chamber while creating a recirculating flow profile, said flow profile being confined by a rotating outer flow of air. For thorough breaking-up of the fuel introduced into the combustion chamber the fuel inlet is constituted by a plurality of inlet ports approximately evenly distributed along a circumference, especially a circle, the liquid-fuel inlet ports and the inlet ports for solid fuel or a fuel emulsion being alternately arranged along said circumference. The fuel inlet ports may be directed either radially and/or at an outward inclination in the direction of flow, based on the longitudinal axis of the combustion chamber. Preferably, a central compressed-air injection is also provided.

28 Claims, 7 Drawing Figures

METHOD OF AND APPARATUS FOR BURNING LIQUID AND/OR SOLID FUELS IN PULVERIZED FROM

DESCRIPTION

Figure 1:
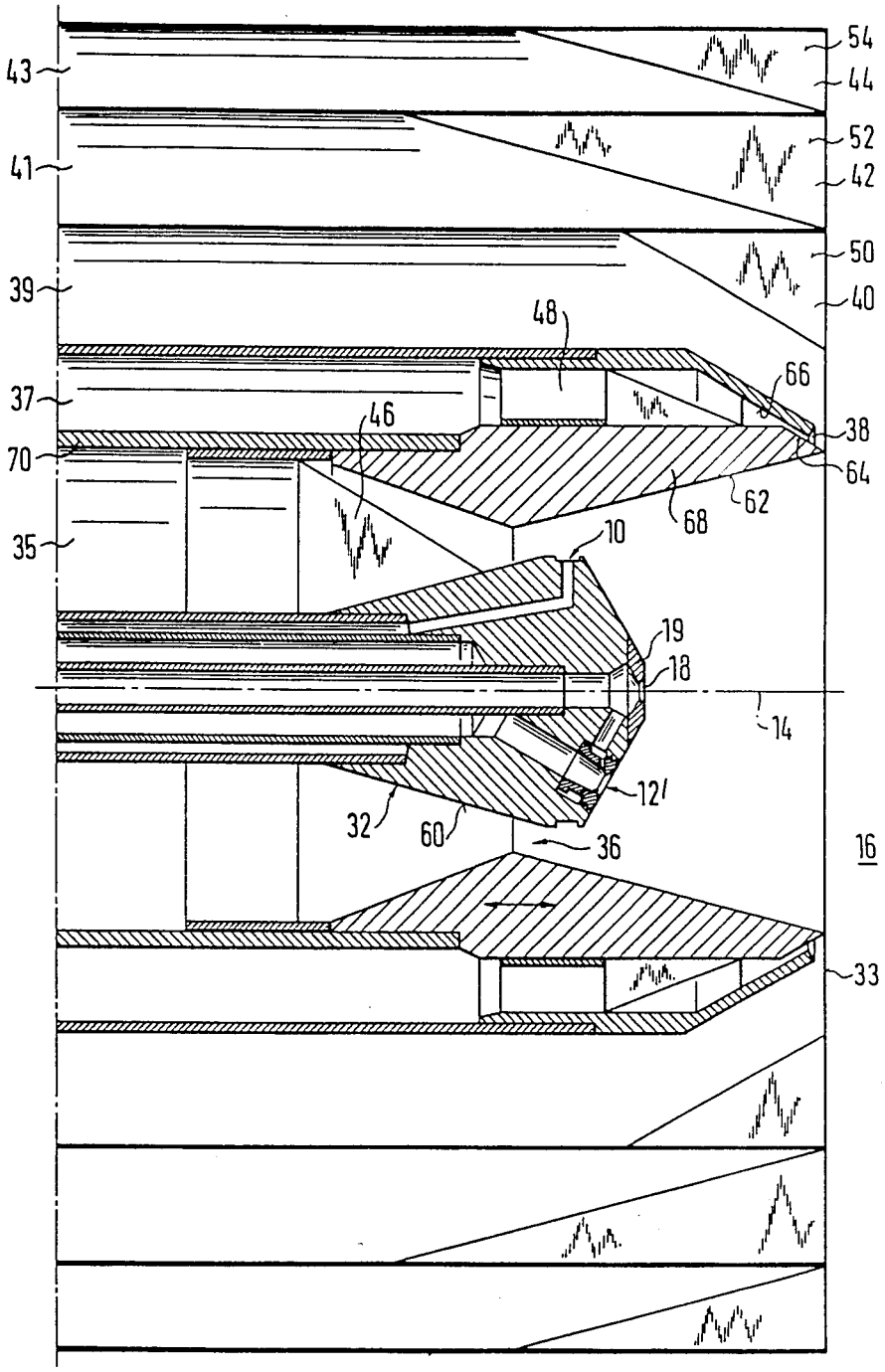

The invention is concerned with a method of and an apparatus for burning liquid and/or solid fuels as specified in the preamble of patent claim 1 and patent claim 14, respectively.

Over the years the most varied proposals have been made for burning both liquid fuels such as oil or the like and solid fuels, especially coal, peat or the like in pulverized form, the latter being mostly introduced into a combustion chamber in admixture with a carrier liquid such as water and/or oil to form an emulsion. Introduction of the fuels into the combustion chamber normally takes place while creating a recirculating flow profile, the latter being confined by a rotating outer flow of air. In practice, combustion of a suspension of pulverized coal in liquid has proven to be relatively difficult; the main problem resides in preventing clogging of the fuel inlet ports or burner jets opening into the combustion chamber. Also, the combustion efficiency has been limited. To overcome these problems, the DD-PS No. 145,316 proposes a burner which is a combination of a so-called rotational burner and a toroidal burner. However, tests have shown that only relatively low efficiencies can be achieved with this burner, above all during the critical starting phase. The reason probably is that atomization of the fuels is insufficient so that problems of ignition will arise especially during the starting phase. Also, enrichment or mixing of the fuels with air is insufficient, whereby the efficiency is likewise reduced.

Proceeding from the above-mentioned prior art, the instant invention is based on the object of providing a method of and an apparatus for burning liquid and/or solid fuels in pulverized form, in which practically complete combustion within the combustion space is possible within a minimum distance, and in which combustion can also be maintained with a high degree of efficiency when solid fuels are supplied.

As regards the method, this object is solved by the characterizing measures set out in patent claim 1; as regards the apparatus, it is solved by the characterizing measures of patent claim 14.

In the invention, the fuels are introduced in finely divided form into the combustion space. Solid and liquid fuels are mixed with each other immediately after introduction thereof into the combustion chamber, whereby combustion can be readily initiated especially during the starting phase. The fuels are introduced in finely divided form into the combustion chamber through one nozzle (in case of small burners) or several nozzles configured as atomizing cones, and due to the alternating arrangement of nozzles and inlet ports for solid and liquid fuels good mixing and thus ready ignition thereof can be achieved. In particular, the introduced fuels are "broken up" into minute fuel particles or droplets. In this way one obtains a maximum fuel surface, whereby practically complete combustion can be achieved within an extremely short distance. The combustion chamber may have a correspondingly short structure.

Following start-up, the supply of oil may be greatly reduced or even shut off so that only the coal or the like, which is introduced into the combustion chamber, is subjected to combustion either in dry state or in admixture with water, oil etc. In this case the outer flow of air appropriately has a temperature of about 100° C. When the temperature of the outer flow of air is below 100° C., additional introduction of oil will be suitable to maintain a high degree of combustion.

It is also possible to shut off the supply of coal or the like and to burn only oil, especially heavy oils. The apparatus (burner) having the structure according to the invention can be used for the combustion of solid fuels and also of liquid fuels, either separately or at a predetermined mixing ratio.

Preferred measures relating to the method and the apparatus are described in detail in the claims 2 to 13 and 15 to 34, respectively. In particular, the central injection of compressed air into the combustion chamber is of special importance; thereby deposits on the end face of the burner jet facing the combustion chamber can be reliably prevented due to the central recirculation of the hot combustion gases and the non-combusted fuel particles entrained therein. Likewise, the measure according to claims 5 and 15, i.e. the radial injection of compressed air, prevents any coal or oil particles entering the combustion chamber from depositing on the end face of the jet body facing the combustion chamber due to the negative pressure prevailing in the central portion immediately downstream of the burner nozzle or the jet body, respectively.

Surprisingly, when the jet body or fuel inlet is recessed in the end wall of the combustion chamber, the measures according to the invention reliably prevent any deposits on the side wall which is opposite to the fuel inlet and confines the flow of air closest to the fuel inlet.

The structural measures specified in claims 20 and 21 are of particular significance in respect of optimum combustion. Due to these features the pulverized fuel introduced into the combustion chamber is actually broken up and fanned out. Thereby a high degree of fine distribution of the fuels and thus rapid ignition is obtained, particularly when the fuels are mixed with liquid fuel such as oil or the like.

Further significant measures are specified in claims 23 to 28, which relate to the outer flow of air and by which the combustion can be substantially influenced, which is particularly true for the flow profile downstream of the fuel inlet. These measures promote spontaneous fanning-out of the fuels introduced into the combustion chamber. Above all, a hollow cone-like flow profile is obtained thereby which assumes an approximately bell-like or apple-like shape. The shape of the flow profile is determined by the equilibrium between the centrifugal forces acting on the fuels and the central "negative pressure" forces.

When water is used as liquid carrier medium for the solid pulverized fuels, the central recirculation of a part of the hot combustion gases additionally offers the considerable advantage that also a part of dissociated water and thus released oxygen is centrally returned to the fuel inlet, whereby combustion is additionally initiated in the interior of the hollow fuel spray cone.

To start combustion, it is preferred to inject only pure oil whereupon pulverized solid fuels are introduced in increasing quantities. As already explained, when the temperature of the outer flow of air and also of the centrally injected compressed air and optionally the compressed air admixed with the solid fuel is sufficiently high, the supply of oil may be shut off completely. When combustion is to be shut off, the reverse process takes place. The pulverized fuel is reduced more and more until the only remaining fuel is oil.

Thereby clotting or clogging of the solid-fuel inlet ports upon starting is reliably prevented.

As was likewise explained above, the solution in accordance with the invention is also highly suitable for the combustion of oil, especially heavy oil. Due to the measures taken in accordance with the invention, a maximum degree of fine division or atomization of the oil fed into the combustion chamber and thus an extremely large free combustion surface are obtained, and consequently practically complete combustion is achieved within a very short distance.

A suitable solid fuel is chiefly coal, e.g. hard coal, bituminous coal, high-gas coal or a mixture thereof.

Figure 2:
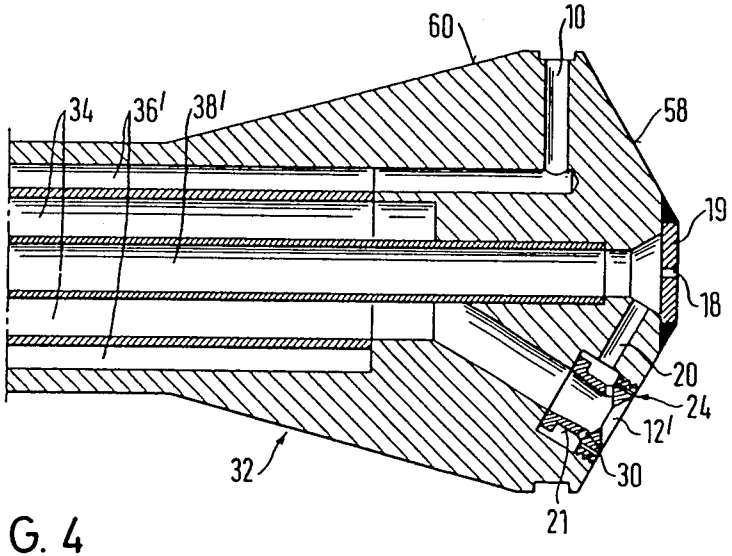
Figure 4:
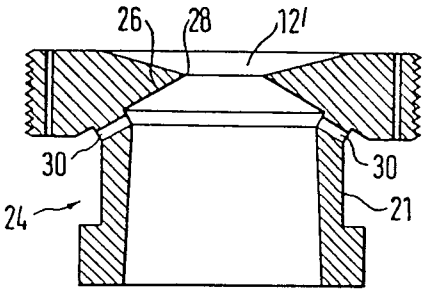
Figure 3:
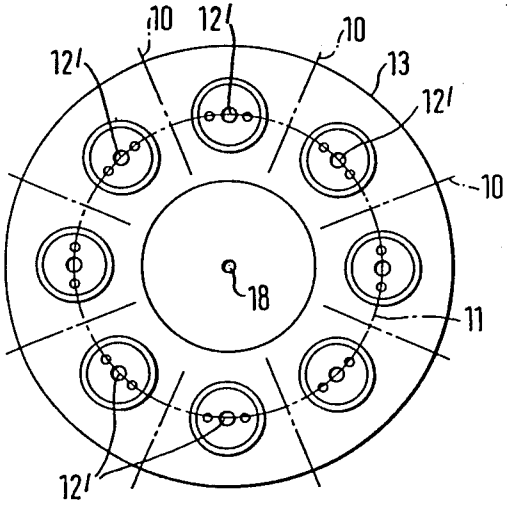
Figure 5:
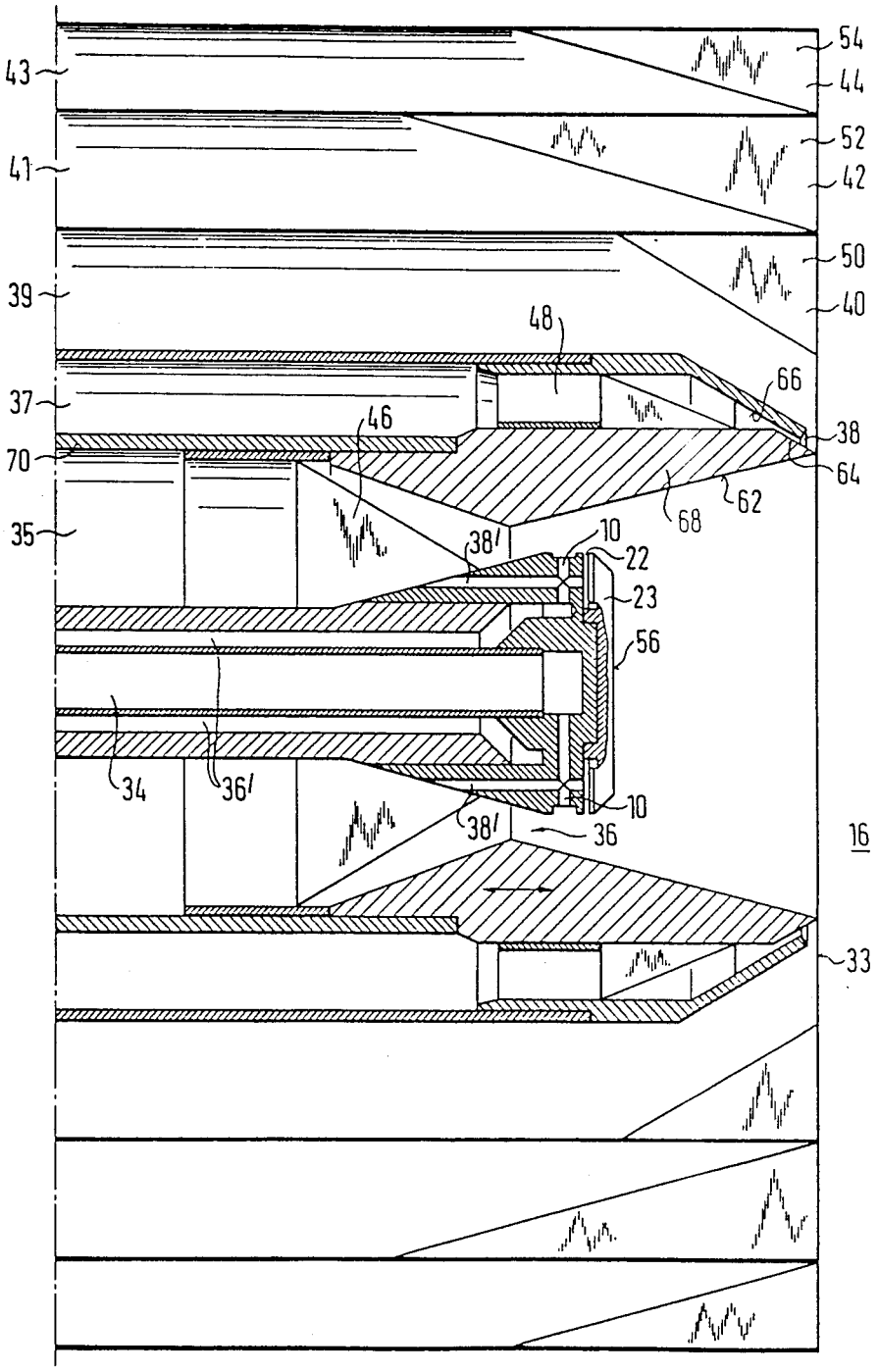
Figure 6:
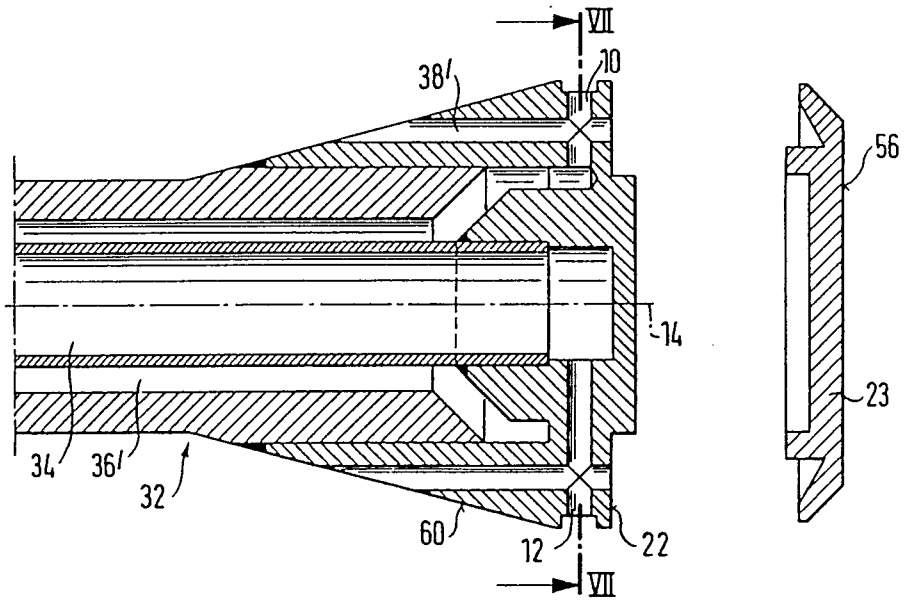
Figure 7:
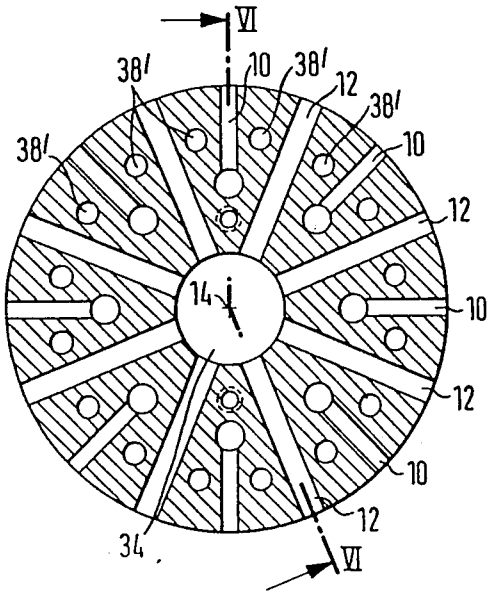

The invention will be described in detail below with reference to two embodiments of an apparatus for performing the method according to the invention. In the drawing FIG. 1 illustrates portions of a first embodiment of the apparatus of the invention (burner portion) in a schematic longitudinal sectional view, FIG. 2 is a longitudinal section illustrating the jet body of the apparatus shown in FIG. 1, FIG. 3 is a front view of the jet body according to FIG. 2, FIG. 4 is an enlarged sectional view illustrating the inlet for solid fuels or fuel emulsions, respectively, FIG. 5 is a schematic longitudinal section through a portion of a second embodiment of the apparatus according to the invention (burner portion), FIG. 6 is a longitudinal sectional view showing the jet body of the apparatus of FIG. 5, and FIG. 7 is a cross-sectional view along the line VII-VII showing the jet body of FIG. 6.

The oil and/or coal burner shown in schematic longitudinal section in FIG. 1 comprises a jet body 32 including fuel inlet nozzles 10, 12' opening into the combustion chamber 16; said jet body is recessed in the end wall 33 of the combustion chamber and is concentrically surrounded by a plurality of gas passageways 35, 37, 39, 41 and 43. The gas passageway 35, which directly surrounds the jet body 32, opens into the combustion chamber 16 through an inlet port 36 which is closest to the fuel inlet. So-called "primary primary air", which may be enriched with higher-temperature combustion gases, flows through the passageway 35, and the gas exiting from the port 36 has a flow rate of 100 to 200 m/s, preferably of about 130 m/s. Each of the side walls 60 and 62 defining the port 36 is of conical shape to provide an annular nozzle. Immediately before exiting, the "primary primary gas" is deflected by baffle members 46 in the form of guide blades by about 70° and is therefore provided with a rotary motion about the longitudinal axis of the jet body or the combustion chamber, respectively. The primary primary gas is blown into the gas passageway 35 at a pressure of about 1000 to 1200 mm head of water.

The gas passageway 35 is concentrically surrounded by a further gas passageway 37 whose annular inlet port 38 which opens into the combustion chamber 16 is likewise defined by conical side walls 64 and 66. However, the side walls 64, 66 extend in such a way that a cone-like flow profile is imparted to the gas stream exiting from the annular port 38, said flow profile penetrating the oppositely directed flow profile of the fuels and of the "primary primary air" exiting from the annular port 36. Due to this feature and to the recessed position of the fuel inlet and the annular port 36 for the primary primary air relative to the annular port 38 for the so-called "secondary primary air", the gas or air stream exiting from said annular port allows breaking-up of the flow profile of the already rotating fuel or fuel mixture, i.e. a further increase in the free surface of the fuel shortly after its exit from the jet body or, respectively, shortly after its entry into the combustion chamber 16.

Before the so-called "secondary primary air", which flows through the gas passageway 37, exits therefrom it is likewise deflected by means of swirl members 48 in the form of guide blades disposed in the vicinity of the annular port 38, and is caused to rotate about the longitudinal axis 14 at an angle of about 40 to 45° relative thereto. The flow rate at which the "secondary primary air" exits is about 120 to 180 m/s, preferably 140 m/s. The annular gap width of the port 38 is variable, like the annular gap width of the port 36, by varying the relative position of the side walls 64, 66 which confine said gaps. Of course, the flow rate at which the "secondary primary air" exits is variable correspondingly. The "secondary primary air" is likewise injected into the annular passageway 37 at a pressure of about 1000 to 1200 mm head of water. The deflection of the "secondary primary air" by the swirl members 48 occurs in the same direction as the deflection of the "primary primary air" by means of the swirl members 46 disposed in the vicinity of the port 36.

Preferably, the "secondary primary air" is not enriched with hot combustion gases, because it does not so much serve as a carrier medium for the fuel introduced into the combustion chamber 16 but rather has the function of increasing the free surface of said fuel and of enriching or supplying the fuel particles or droplets with oxygen.

The assembly comprising the jet body 32, the annular passageway 35 immediately surrounding the same, and the annular passageway 37 through which the "secondary primary air" passes, is adapted to be mounted as a unit in the end wall 33 of the combustion chamber 16 or, respectively, in the gas damper 39, 41, 43 described below, and therefore it is also readily replaceable by a corresponding, somewhat modified assembly.

The gas passageway 37 for the "secondary primary air" is in turn surrounded by a concentric gas passageway 39, which is again surrounded by a further gas passageway 41, and the latter is finally surrounded by a still further gas passageway 43 all in concentric relationship. The respective annular ports opening into the combustion chamber 16 are indicated at 40, 42 and 44. Flow through the annular passageways 39, 41 and 43 is selective and preferably comprises air which is injected at a pressure of about 200 to 300 mm head of water. Before the air exits from the annular gas or air inlet ports 40, 42, 44 it is deflected by means of swirl elements 50, 52, 54 in the form of guide blades disposed in the vicinity of the ports and is thus given a rotary motion about the longitudinal axis 14, and that in the same direction in which the "primary primary air" and the "secondary primary air" are deflected by the swirl elements 46 and 48, respectively.

The swirl elements 50 cause deflection of the flow of gas or air by about 70° . The swirl elements 52 and 54 cause deflection of the flow of gas or air by about 40 to 50° and 0 to 40° , respectively. All of the swirl elements, in particular the outermost swirl elements 54, are variable in respect of their angular position and may thus be matched to the fuel or the fuel mixture to be subjected to combustion.

The flow rate of the air exiting from the annular port 40 is about 40 m/s upon starting of combustion and about 70 m/s in full-load operation. The flow rate of the air exiting from the annular ports 42 and 44 varies between 0 m/s upon starting of combustion and up to 70 m/s in full-load operation.

The discharge velocities of the "primary primary air" and the "secondary primary air" remain approximately the same under all conditions of operation between starting and full load. It is only the discharge volume or the throughput which is varied by correspondingly increasing or decreasing the gap widths of the annular ports or gaps 36 and 38. The gap widths are varied similarly. To this end an annular mouth piece 68, which comprises the two adjacent or mutually facing side walls 62 and 64 of the two annular ports 36 and 38, is mounted for reciprocal movement in axial direction or in the direction of the longitudinal axis 14, respectively. In the embodiment illustrated in FIG. 1, the annular mouth piece 68 is joined to the tubular jacket 70 which separates the two primary air passageways 35, 37 from each other, so that the axial movement of the annular mouth piece 68 takes place by corresponding action on the tubular jacket 70. During starting, the annular mouth piece 68 is moved to the right in FIG. 1, so that the gap widths of the annular ports 36 and 38 and thus the volume of exiting primary air are minimum. For full load operation conditions are reversed, i.e. the annular mouth piece 68 is moved to the left in FIG. 1, so that the degree of opening of the annular ports 36 and 38 is maximum. The discharge volume of the "primary" and the "secondary" primary air is likewise maximum.

The outermost gas or air flow through the annular passageway 43 mainly has the function of reducing the $NO_x$ content externally of the flame in the combustion chamber 16. Furthermore, this flow confines the radial extension of the flame and prevents deposits on the side walls of the combustion chamber 16.

Pulverized fuel, e.g. carbon powder, may also be injected through the annular passageway 39, either in admixture with or instead of secondary air. This is possible especially during full load operation and is beneficial in case of energy peaks.

The core of the apparatus according to the invention is the configuration of the jet body 32 with the illustrated arrangement of the inlet ports 10 and 12' for oil and solid fuels. This configuration will be described in detail with reference to FIGS. 2 to 4.

The fuel inlet is constituted by a plurality, i.e. 16, inlet ports 10, 12' uniformly distributed along a circle 11 and 13, respectively, wherein the inlet ports 10 for liquid fuel, especially oil, and the inlet ports 12' for solid fuel or a fuel emulsion are alternately arranged along the circumference. The liquid fuel inlet ports 10 are radially outwardly directed along an inwardly offset circle 13, whereas the solid fuel inlet ports 12' extend obliquely outwardly in the direction of flow along a circle 11 which is farther outward or nearer the combustion chamber 16 relative to the longitudinal axis 14 of the combustion chamber 16.

Moreover, a central inlet 18 extending coaxially to the longitudinal axis of the jet body 32 or the combustion chamber 16 is provided for the injection of compressed air. Any deposits of coal or coal dust on the end face of the jet body 32 which faces the combustion chamber are thereby reliably prevented. Upstream of the central compressed air-inlet 18, connecting lines 20 are branched off which open into the solid-fuel inlet ports 12', i.e. properly speaking into nozzles 24 respectively forming the solid-fuel inlet ports 12' (see FIGS. 2 and 4). The nozzles 24 each include an annulus 26 of triangular cross-section, one annular edge 28 of said cross-section defining or, respectively, confining the inlet port 12' opening into the combustion chamber 16. Within the nozzles 24 compressed-air ducts 30 directed towards the inlet port 12' are provided which are in fluid communication with the above-mentioned compressed-air connecting lines or branch lines 20 within the jet body 32. The fluid communication is via an outer annular space defined, on the one hand, by the jet body and, on the other hand, by an annular groove 21 within the nozzle 24, the compressed-air connecting line or branch line opening into said annular space and a plurality of compressed-air ducts 30 being furthermore connected to said annular space and being approximately evenly distributed over the circumference of the nozzle 24 (see FIGS. 2 and 3).

On account of the relatively sharp annular edge 28, by which the solid-fuel inlet port 12' is defined, the fuel flow is broken up to form a "spray cone". This effect is additionally intensified by the injection of compressed air through the compressed-air ducts 30. By means of the injected compressed air the formation of a "spray cone" may be readily varied or matched to the respective desired conditions or the type and quality of the fuel which is to be combusted. With the described structure, the introduced fuel is therefore already distributed to several discrete nozzles where it is additionally greatly "broken up" so that maximum fine distribution and the formation of a maximum free or combustion-active surface result.

Preferably, the mouth pieces 24 are exchangeably mounted in the jet body, for instance by threaded engagement therein. It is thereby possible to achieve adaptation to the fuels which are to be combusted. The various jet bodies may be distinguished by different-size inlet ports 12' and/or different numbers or dimensions of compressed-air ducts 30, respectively. It is further possible to provide mouth pieces 24 in which the annular edge 28 defining the inlet port 12' is somewhat rounded off, stepped or flattened. However, a tapering annular edge 28 is most suitable.

The central compressed-air inlet 18 may likewise be disposed within an insert 19 adapted to be threaded into the end of the jet body 32 facing the combustion chamber 16. In this way it is possible by using a different insert 19 to vary the free cross-section and the shape of the inlet 18 (see FIG. 2 in comparison with FIG. 1, where the shape of the inlet 18 approximately corresponds to that of the solid-fuel inlet port 12').

As explained above, deposits on the end face of the jet body 32 facing the combustion chamber are avoided due to the central injection of compressed air. There, the centrally recirculating combustion gases, which have a temperature of from about 1500 to 1700° C., are deflected and again carried into the combustion chamber 16 by introduced fuel, especially by the solid fuel introduced through the inlet ports 12', where the hot combustion gases cause ignition of the relatively cold fuels or fuel emulsion immediately after exiting of the same, so that the combustion process is initiated relatively closely downstream of the fuel inlet port 12', such ignition being additionally promoted—especially during the starting phase—by the oil introduced radially (through the inlet ports 10). The flame envelope is determined by the equilibrium between the centrifugal forces due to rotation and the forces caused by the negative pressure prevailing externally of the flame envelope in the region of the end wall 33, on the one hand, and the counterforces within the flame envelope caused by the central negative pressure upstream of the jet body, on the other hand.

Upon starting of combustion, the two outermost gas or air passageways 52, 54 are closed. The annular port 40 is adjusted such that the rate of flow of the exiting air is about 40 m/s. The annular mouth piece 68 is displaced, as explained above, towards the combustion chamber 16 so that the annular gaps between the side walls 60, 62 and 64, 66, respectively, are decreased, whereby the discharge volume of the "primary" and the "secondary" primary air is reduced while the discharge velocity is somewhat increased. Due to the somewhat elevated exiting velocity, especially of the "secondary primary air" from the annular port 38 directed towards the introduced fuel, a high break-up effect is achieved. The primary air is divided during the starting operation such that about 60 to 70%, preferably 90% thereof exit from the annular port 36 closest to the fuel inlet, while only about 30 to 40%, preferably 10% thereof exit from the second-closest annular port 38.

During full-load operation, in which the total quantity of primary air is increased, the ratio between "primary" and "secondary" primary air is about 3:7. This will show that upon starting a concentrated strong flow of gas is required in the immediate vicinity of the introduced fuel to break the fuel up and to facilitate initiation of combustion on account of the increased surface of the fuel. Breaking up of the fuel into extremely small particles or droplets is additionally facilitated by the fact that the fuel is introduced into the combustion chamber through a multiplicity of inlet ports. The relatively compact fuel is therefore already divided when it is fed or injected into the combustion chamber, wherein a first breaking-up occurs in the vicinity of the inlet ports and a secondary breaking-up is caused by the outer gas or air flow. The described variation of the quantitative proportion between "primary" and "secondary" primary air with a simultaneous variation of the capacity or discharge volume as a whole is readily obtained by a corresponding configuration of the axially movable annular mouth piece 68 as shown, for instance, in FIG. 1 or FIG. 5, which has approximately trapezoidal cross-section.

As already explained above, the deflection of the radially outermost discrete gas or air flow by means of the guide blades or swirl elements 54 is less pronounced and may even be zero. Thereby the radial extension of the flame envelope is considerably influenced.

The aforementioned admixing of combustion gases to the "primary primary air" offers two advantages. Firstly, both the liquid and the solid fuel may be preheated along their paths through the passageways 34, 36, 38. Secondly, a certain degree of post-combustion and thus increased efficiency may be achieved. These two advantages compensate for the drawback of a lower oxygen content. When only coal is subjected to combustion, however, it is appropriate to do without the admixture of combustion gases. For the rest, the drawback of a lower oxygen content might be compensated by oxygen enrichment of the other discrete gas or air flows ("secondary air"). When a coal-water-mixture is burned, it is preferred to add wetting agents which ensure uniform distribution of the coal particles in the water.

The embodiment illustrated in FIGS. 5 to 7 differs from that illustrated in FIGS. 1 to 4 only by a different structure of the jet body. All other features are the same and are also provided with the same reference numerals, so that the following description shall be limited to the jet body, reference being made to FIGS. 6 and 7.

The jet body 32 shown in FIGS. 6 and 7 comprises a central feed line 34 for solid fuels such as pulverized coal with or without water, oil or the like, an annular line 36' for liquid fuel such as oil or the like concentrically surrounding the former, and a compressed-air feed line 38', which concentrically surrounds said annular oil passageway and comprises a plurality of line bores evenly distributed about a circle. The feed lines 34 and 36' for solid and liquid fuel open into radially directed inlet ports 10 and 12, respectively, which are evenly distributed along the circumference, as will be readily apparent from FIG. 7. Similar to the embodiment shown in FIGS. 1 to 4, a total of eight inlet ports 10 and 12 is respectively provided for solid and liquid fuel.

The compressed-air lines 38', which extend in parallel to the longitudinal axis 14 of the jet body 32 or the combustion chamber 16 and to which "primary primary air" is supplied from the gas or air passageway 35 directly surrounding the jet body 32, open into a radially open annular gap 22 which is downstream of the radially directed inlet ports 10, 12 in the direction of flow. The annular gap 22 is defined by a cover plate 23 attached to the end face of the jet body 32 with the aforementioned radially extending annular gap 22 being left clear (see also FIG. 5).

The cover plate 23 has a planar face 56, whereas the jet-body face 58 facing the combustion chamber 16 in FIGS. 1 to 4 is frusto-conical. Of course, a corresponding configuration of the face 56 is conceivable.

A deposit of exiting solid or liquid fuel on the face 56 as well as a deposit of fuels or fuel residues on the confining wall 62 closest to the gas or air inlet port 36' of the jet body 32, which wall 62 is opposite to the fuel inlet, is reliably prevented by the "primary primary air" radially flowing from the annular gap 22. Additionally, a central compressed-air injection according to the embodiment shown in FIGS. 1 to 4 may be provided in the embodiment shown in FIGS. 5 to 7.

It is also conceivable to provide the jet body 32 so as to be reciprocally movable within the gas damper system in axial direction or in the direction of the longitudinal axis 14, whereby the gap width of the annular port 36 for the discharge of the "primary primary air", on the one hand, and the recessed mounting of the jet body and thus of the fuel inlet in the end wall 33 of the combustion chamber 16, on the other hand, are variable or adjustable in dependence on the constitution and on the type of fuel.

With smaller burners the outer gas damper for secondary air may be omitted.

All of the features disclosed in the application papers are claimed as being essential to the invention to the extent to which they are novel over the prior art either individually or in combination.

I claim:

1. A method of burning liquid fuels such as oil or the like and/or solid fuels, especially coal, peat or the like, in pulverized form, the latter either in dry condition or mixed with a carrier liquid such as water and/or oil to form an emulsion being introduced together with the liquid fuel into a combustion chamber while creating a recirculating flow profile, said flow profile being confined by a rotating outer flow of air, characterized in that the solid and liquid fuels are introduced into the combustion chamber separately and—in case of plural fuel inlets alternatingly—at a predetermined angular distance from each other along a circumference, especially along an imaginary circle.

2. A method as claimed in claim 1, characterized in that both the solid and the liquid fuels are introduced into the combustion chamber radially outwardly, based on the longitudinal axis of said combustion chamber.

3. A method as claimed in claim 1, characterized in that the solid and/or liquid fuels are introduced into the combustion chamber at an outward inclination in the direction of flow, based on the longitudinal axis of said combustion chamber.

4. A method as claimed in claim 1, characterized in that compressed air is centrally injected into the combustion chamber.

5. A method as claimed in claim 2, characterized in that the compressed air is injected into the combustion chamber in the immediate vicinity of the fuel inlet, wherein the injection preferably takes place approximately evenly along the circumference of an annular gap or the like.

6. A method as claimed in claim 1, characterized in that upon entry into the combustion chamber, the solid fuels or the fuel emulsion is additionally admixed with compressed air, preferably immediately before introduction thereof into the combustion chamber, whereby the fuel feed is simultaneously broken up.

7. A method as claimed in claim 6, characterized in that the compressed air is directed towards the fuel feed, especially at an inclination relative to the direction of fuel flow.

8. A method as claimed in claim 1, characterized in that the outer flow of air is injected into the combustion chamber in the form of a plurality of concentric partial flows, the partial flows being respectively variable as to their flow rate and their flow velocities decreasing from the inside towards the outside.

9. A method as claimed in claim 8, characterized in that combustion gases are admixed at least to the flow of air closest to the fuel inlet.

10. A method as claimed in claim 8, characterized in that upon starting of the combustion, the air flow rate is about 20 to 40% of that during full-load operation.

11. A method as claimed in claim 8, characterized in that the two flows of air nearest the fuel inlet have approximately constant flow velocities under all operational conditions.

12. A method as claimed in claim 8, characterized in that the flow of air ("primary primary air") adjacent the fuel inlet is introduced at an angle of about 10 to 30°, preferably an angle of 15° to the radial.

13. A method as claimed in claim 12, characterized in that the radially farther outward flow of gas ("secondary primary air") is directed such that an approximately hollow-conical gas or air flow profile is created, which is directed towards the approximately hollow-conical fuel flow profile and which tends to penetrate the same and breaks it up.

14. An apparatus for burning liquid fuels such as oil or the like and/or solid fuels, especially coal, peat or the like, the latter either in dry condition or mixed with a carrier liquid such as water and/or oil to form an emulsion being introduced together with the liquid fuel into a combustion chamber, the fuel inlet being concentrically surrounded by an air inlet, especially for performing the method as claimed in any of the claims 1 to 13, characterized in that said fuel inlet is respectively constituted by one or several inlet ports, approximately evenly distributed along a circumference, especially a circle, wherein the liquid fuel inlet ports and the inlet ports for solid fuel or fuel emulsion are alternatingly arranged along said circumference.

15. An apparatus as claimed in claim 14, characterized in that the inlet ports extend either radially and/or at an outward inclination in the direction of flow, based on the longitudinal axis of the combustion chamber.

16. An apparatus as claimed in claim 14, characterized in that a central inlet for compressed air is provided.

17. An apparatus as claimed in claim 16, characterized in that connecting lines branch off from the central compressed-air inlet or from the compressed-air line leading thereto and extend to the solid-fuel inlet.

18. An apparatus as claimed in claim 17, characterized in that the connecting lines open at to fuel inlet immediately upstream of the inlet ports, preferably at an inclination to the flow direction of the fuel feed and directed towards the same.

19. An apparatus as claimed in claim 14, characterized in that a radially open annular gap is provided as compressed-air inlet and is preferably disposed downstream of the fuel inlet in the direction of flow.

20. An apparatus as claimed in claim 14, characterized in that the solid-fuel inlet is formed by a mouth piece including an inlet port opening into the combustion chamber, said inlet port being defined by the edge of an annular portion of approximately triangular cross-section.

21. An apparatus as claimed in claim 20, characterized in that the mouth piece includes compressed-air ducts directed towards the inlet port, said ducts via the connecting line being in fluid communication with the central compressed-air inlet or with the compressed-air line leading to said inlet.

22. An apparatus as claimed in claim 14, characterized in that the solid and liquid fuels and optionally compressed air can be supplied to the respective inlet ports through passageways coaxially provided within a jet body.

23. An apparatus as claimed in claim 14, characterized in that the air inlet portion is configured as a damper system having at least four concentric air inlet ports, swirl elements being associated with each air inlet port and the annular gap width of the two air inlet ports closest to the fuel inlet being adapted to be progressively varied, while the remaining air inlet ports somewhat farther from the fuel inlet in radial direction are adapted to be closed or opened individually.

24. An apparatus as claimed in claim 23, characterized in that a jet body comprising the fuel inlet is mounted for displacement in the direction of its longitudinal axis or the longitudinal axis of the combustion chamber, but is especially adapted to be moved to a position in which the fuel inlet is rearwardly offset or recessed relative to the end wall of the combustion chamber.

25. An apparatus as claimed in claim 23, characterized in that the central end face of the jet body facing the combustion chamber has either planar or frusto-conical, spherical-segment (convex or concave), conical or similar configuration.

26. An apparatus as claimed in claim 23, characterized in that the annular gap width of the two air inlet ports closest to the fuel inlet may be respectively varied by varying the relative position of the side walls defining the inlet ports.

27. An apparatus as claimed in claim 23, characterized in that the annular gap width of the two air inlet ports closest to the fuel inlet is similarly variable, i.e. by moving an annular mouth piece comprising the two adjacent side walls of the two air inlet ports towards the longitudinal axis of the jet body or the combustion chamber, respectively, wherein the annular mouth piece preferably forms a part of the tubular jacket or the like which separates the two partial flows of air closest to the fuel inlet from each other.

28. An apparatus as claimed in claim 23, characterized in that the air inlet port second-closest relative to the fuel inlet is directed such that the corresponding flow of air assumes an approximately hollow cone-shaped flow profile directed towards the approximately hollow cone-shaped flow profile of the introduced fuel.

* * * * *